US008152090B2

(12) United States Patent
Matthies

(10) Patent No.: US 8,152,090 B2
(45) Date of Patent: Apr. 10, 2012

(54) TAKE-UP DEVICE

(75) Inventor: Claus Matthies, Wasbek (DE)

(73) Assignee: Oerlikon Textile GmbH & Co. KG, Remscheid (DE)

( * ) Notice: Subject to any disclaimer, the term of this patent is extended or adjusted under 35 U.S.C. 154(b) by 119 days.

(21) Appl. No.: 12/138,949

(22) Filed: Jun. 13, 2008

(65) Prior Publication Data

US 2008/0245921 A1 Oct. 9, 2008

Related U.S. Application Data

(63) Continuation of application No. PCT/EP2006/011933, filed on Dec. 12, 2006.

(30) Foreign Application Priority Data

Dec. 15, 2005 (DE) ..... 10 2005 059 871

(51) Int. Cl.
*B65H 54/24* (2006.01)
*B65H 54/28* (2006.01)
*B65H 65/00* (2006.01)

(52) U.S. Cl. ..... 242/474.7; 242/476.2; 242/481; 242/483.3

(58) Field of Classification Search ..... 242/473.7, 242/473.8, 476.1, 476.2, 481, 482.9, 483.3, 242/474.5, 474.6, 474.7
See application file for complete search history.

(56) References Cited

U.S. PATENT DOCUMENTS

| | | | | |
|---|---|---|---|---|
| 4,085,901 | A * | 4/1978 | Sanders | 242/476.1 |
| 4,216,920 | A * | 8/1980 | Tambara et al. | 242/474.6 |
| 4,899,529 | A * | 2/1990 | Fumio | 57/261 |
| 5,485,967 | A * | 1/1996 | Ray et al. | 242/474 |
| 6,027,063 | A * | 2/2000 | Jaschke | 242/476.1 |
| 2005/0023406 | A1 * | 2/2005 | Matthies | 242/473.5 |

FOREIGN PATENT DOCUMENTS

| | | |
|---|---|---|
| DE | 197 30 721 A1 | 1/1998 |
| DE | 103 33 273 A1 | 2/2005 |
| JP | 59-223665 A | 12/1984 |
| JP | 59-223666 A | 12/1984 |

OTHER PUBLICATIONS

The International Search Report for International Appl. No. PCT/EP2006/011933, completed Mar. 7, 2007.
The International Preliminary Report on Patentability for International Appl. No. PCT/EP2006/011933, issued Jul. 8, 2008.

* cited by examiner

*Primary Examiner* — William A Rivera
*Assistant Examiner* — Scott Haugland
(74) *Attorney, Agent, or Firm* — Alston & Bird LLP

(57) ABSTRACT

The invention relates to a method for catching and taking up as well as a winding machine for continuously winding up threads. In order to catch the thread on a winding spindle, two thread guides form a thread section upstream and downstream of the winding spindle. Preferably, said thread guides are simultaneously displaced in a synchronous manner during the catching process and in such a way that the thread section is guided vertically over the winding spindle. Preferably, the thread guides are simultaneously and synchronously displaced by coupling the thread guides to each other and displacing the same with the aid of a common drive unit.

18 Claims, 5 Drawing Sheets

TAKE-UP DEVICE

CROSS-REFERENCE TO RELATED APPLICATIONS

The present application is a Continuation of International Application No. PCT/EP2006/011933, filed Dec. 12, 2006, and which designates the U.S. The disclosure of the referenced application is incorporated herein by reference.

FIELD OF THE INVENTION

The present invention relates to a method and winding machine for winding a continuously advancing yarn.

BACKGROUND OF THE INVENTION

A winding method and a winding machine of the generic kind have been disclosed in the unexamined laid-open patent application DE 29 07 848 A1 (related to U.S. Pat. No. 4,216,920). Winding machines are used to wind up continuously advancing yarns into bobbins. For this purpose, the yarns are first traversed by a traversing device transversely to the running direction of the yarn and guided over a rotating contact roller. The contact roller places each of the yarns on the likewise rotating bobbins that are to be wound up. A plurality of bobbins is disposed in mutual alignment and one after the other on a common winding spindle. It is thus possible to wind up several yarns simultaneously.

For changing the bobbins automatically, the winding machines are designed with several winding spindles, which are mounted in a projecting manner on a spindle support, which can rotate about an axis. The winding spindle is swiveled alternately into a winding range and into a doffing range by rotating the spindle support. Each yarn is wound up on the tube of a bobbin in the winding range. After the bobbin is wound completely, the winding spindle is swiveled into the doffing range by means of the spindle support. The rotation of the spindle support causes the winding spindle equipped with empty tubes to simultaneously swivel out of the doffing range into the winding range. The yarn, which is still advancing before the bobbin, thus comes into contact with the other winding spindle, which is already rotating in this phase. Catch elements, which catch the advancing yarn, are provided on the winding spindle or on the empty tubes. This winding spindle now winds up the yarn. The yarn connection between the two winding spindles is cut off or torn off using cutting means during this process. The full bobbin is then replaced with an empty tube in the doffing range. During the doffing process described above and immediately before the separation of the yarn connection between the completely wound up bobbin and the tube to be wound up, the yarn accumulates on a defined portion of the completely wound bobbin. This results in a yarn bead, which is considered to be the conclusion of the winding of the bobbin.

The reliability of the yarn changing process, in particular, is at the focal point of all considerations when developing winding machines. Firstly the catch element and secondly the yarn guide are factors relevant to the yarn changing process.

It is known from the prior art to either integrate the catch element into the tube or to provide the same on the winding spindle. Integrating the catch element into the tube implies tubes that require complex manufacturing processes and are therefore more expensive. However, in the case of a catch element provided on the winding spindle, the yarn requires stronger deflection since the catch element is located further outside the traversing range of the yarn. It is disclosed, for example, in the unexamined laid-open patent application DE 25 40 853 A1 (related to U.S. Pat. No. 4,019,690) to displace the winding spindles axially instead of deflecting the yarn strongly. However, as a result of increasingly long winding spindles designed to receive an ever increasing number of bobbins and also as a result of ever increasing winding speeds, it is no longer possible to implement this solution in modern winding machines requiring high levels of rigidity and having bearings that are free of play.

The invention disclosed in DE 29 07 848 A1 provides a plurality of yarn-guiding elements to axially deflect the yarn to a sufficient extent during the yarn changing process and at the same time to firstly guide it perpendicularly to the axis of the winding spindle over the catch element and secondly guide it within the traversing range on the completely wound bobbin. This is a first yarn-guiding element, which is disposed before the catch element and which guides the yarn out of the traversing range and into the range of the catch element. Furthermore, a second yarn-guiding element is disposed behind the catch element in the running direction of the yarn. After the first yarn-guiding element has guided the yarn out of the traversing range, the second yarn-guiding element guides the yarn into the sphere of action of the catch element. Finally, a third yarn-guiding element is disposed in such a way behind the second yarn-guiding element, when seen in the running direction of the yarn, that the yarn is guided back into the traversing range.

The guidance of the yarn in the yarn catching process is of special importance in connection with high winding speeds. This is firstly because the reliability of catching the yarn reduces as the winding speed increases. Furthermore, as an aggravating factor it has to be added that the lesser reliability in catching the yarn cannot be compensated by a higher dwell time in the range of the catch element since a large amount of yarn accumulates in this range very rapidly. Rather, it would be actually necessary to reduce the dwell time in the range of the catch element as the winding speed increases, thereby resulting in a conflict of objectives.

It is therefore an object of the invention to improve the reliability of catching the yarn using the winding machines known from the prior art.

SUMMARY OF THE INVENTION

The invention follows the approach of improving the precision, with which the yarn is guided over the catch element at the moment at which it is caught by the catch element. This is achieved by a method in which a section of the thread, which is running from the yarn source to a storage means such as a full bobbin or a yarn suction nozzle, is displaced and thus fed to the catch element by guiding the yarn section between two yarn guides that can move in the axial direction of the winding spindle and by simultaneously moving these two yarn guides.

In one form of the method of the invention, the movement of the yarn guides is divided into two movement sections. In a first movement section, the yarn section is initially guided toward the catch element. This guidance can be effected out of the traversing range of the full bobbin in the case of a bobbin change. The yarn section is then finally fed to the catch element in a second movement section so that the yarn section cooperates with the catch element. In the second movement section, the yarn guides that define and guide the yarn section are moved simultaneously.

In a preferred form of the method of the invention, the yarn guides are moved at the same speed.

In a particularly preferred form of the method of the invention, the yarn section is substantially orthogonal to the axis of rotation of the winding spindle so that the yarn section is ideally guided into the catch element.

In one version of the method of the invention, an inversion of direction is effected between the first and the second movement sections. The yarn section can thus be guided back into the traversing range immediately after the yarn is caught.

In other forms of the method of the invention, the yarn guides are partly moved one after the other or independently of each other. This makes it possible to allow for process flows that take place immediately before the bobbin change.

In a particularly preferred form of the method of the invention, the running direction of the yarn and the peripheral speed of the catch element on the winding spindle are parallel. This allows the yarn to be caught in the catch element without any jerks. During the catching process and until the yarn is taken over by the winding spindle, the yarn is wound on a bobbin, which is clamped on a second winding spindle. In doing so, the yarn is guided by a third yarn guide in such a way that the yarn accumulates on the peripheral surface of the bobbin.

In a winding machine of the present invention used for implementing the method of the invention, there are means, which precisely maintain the angle and the speed at which the yarn section is guided transversely over the catch element. The object of the invention of ensuring this precision is achieved by using a common drive for driving those two yarn guides in an interconnected manner that are relevant to the precision of yarn guidance at the moment at which the yarn is caught. This helps guide the yarn with precision. In a preferred embodiment, a third yarn guide is provided, which again guides the yarn behind the second yarn guide and into the traversing range of the bobbin.

The connection between the first and the second yarn guide can be a mechanical connection. But it is also feasible and within the scope of the present invention to design this connection such that the common drive means is made of two individual drives, which are coordinated by means of a control mechanism in the sense that they can be moved synchronously.

In a preferred refinement of the invention, the two yarn guides are initially displaced out of the traversing stroke in a first direction of movement using independent drive means. It is thus possible to independently move each of the yarn guides for guiding the yarn in a manner that is optimum for this situation. The yarn guides are then interconnected and moved by the common drive means in a second direction of movement that is relevant to the catching process.

In order to move the two yarn guides independently of each other in one direction of movement and jointly in the other, the common drive means and at least one of the yarn guides are interconnected with play. In an alternative embodiment, this connection can also be flexible.

In a particularly preferred refinement of the invention, the drive means work pneumatically. Pneumatic drives in the form of pneumatic cylinders are especially suitable for linear movements. Furthermore, two pneumatic cylinders can be effectively used together for movements in opposite directions by switching the respective inactive pneumatic cylinder to a depressurized state.

The catch element is preferably designed such that a catch hook catches the yarn during its transverse movement in the direction in which the yarn guides are driven jointly.

For increasing the reliability of catching the yarn, a catch groove is used, in which the yarn is additionally guided during the catching process and thus stabilized.

Likewise, the reliability of catching the yarn is achieved by guiding the yarn substantially perpendicularly to the axis of the winding spindle. Whether this forms an exactly 90° angle or an angle that slightly deviates from the perpendicular is ultimately decided by the structure and kinematics of the winding machine and can be determined empirically.

Therefore, in a refinement of the invention, an adjusting element is provided using which this angle between the yarn and the axis of the winding spindle can be adjusted.

As an alternative to arranging the catch element on the winding spindle, it is also possible for the catch element to be disposed on the tube.

BRIEF DESCRIPTION OF THE DRAWINGS

Exemplary embodiments are described in more detail below with reference to the attached drawings, in which.

DETAILED DESCRIPTION OF PREFERRED EMBODIMENTS

Figure 1:
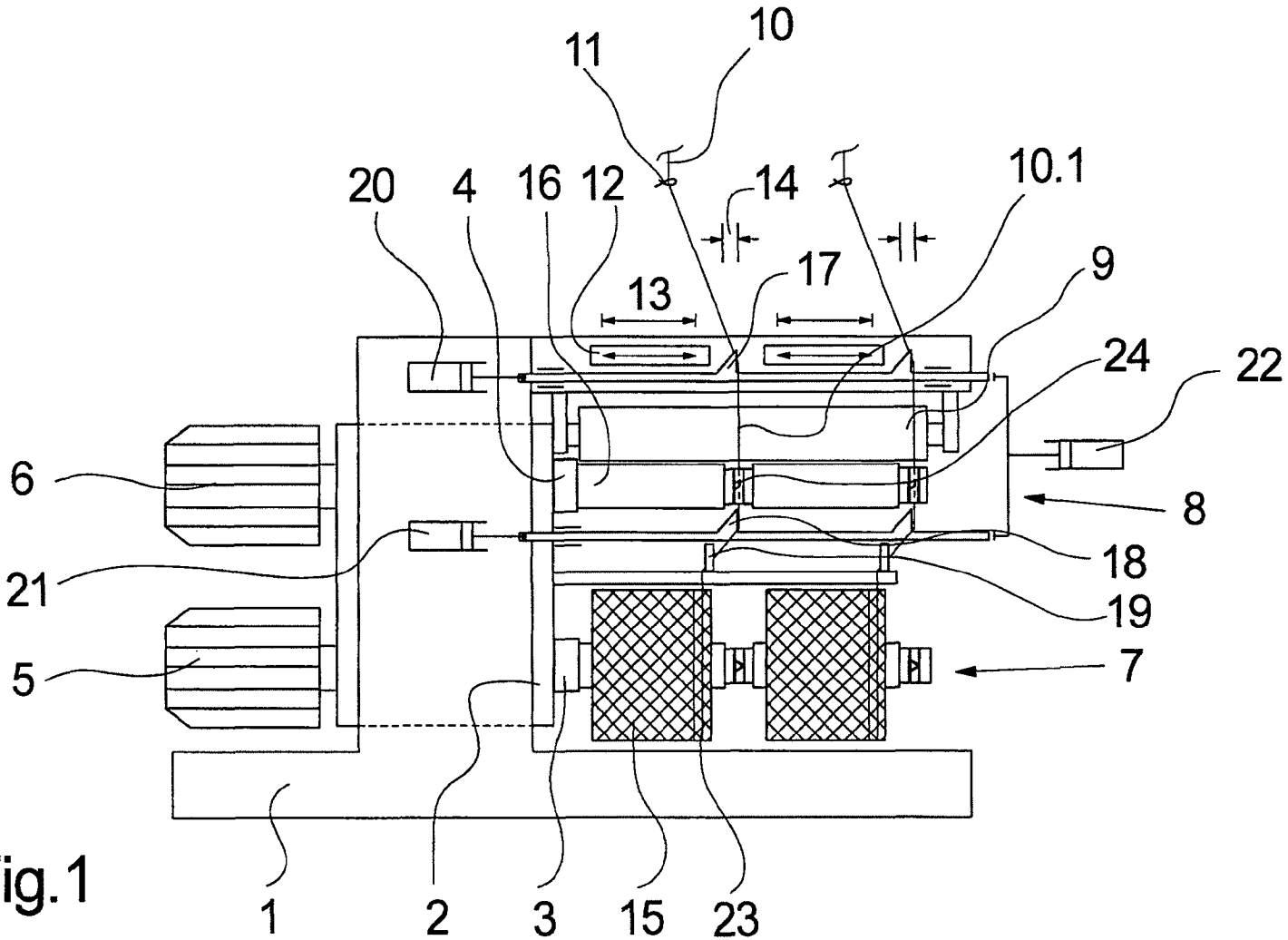
FIG. 1 shows a winding machine in accordance with an exemplary embodiment of the invention.
Figure 2:
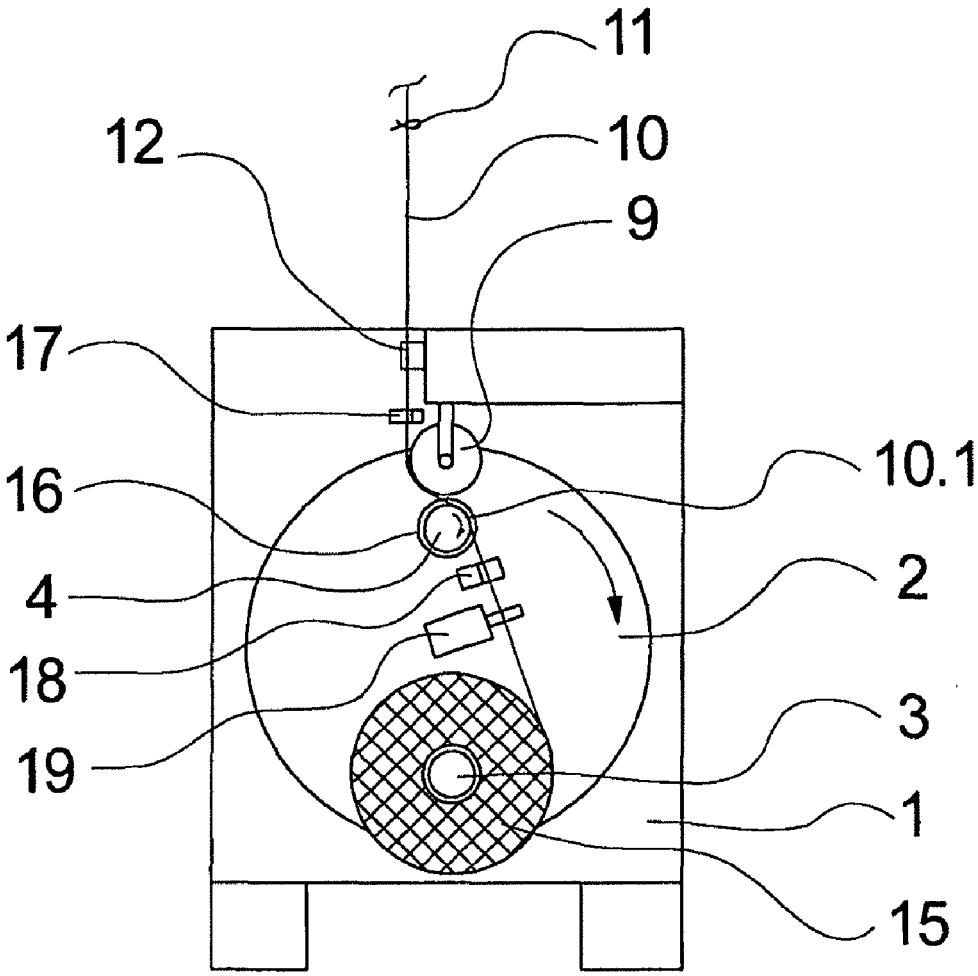
FIG. 2 shows a front view of the winding machine of the exemplary embodiment of the invention shown in FIG. 1.

FIG. 1 and FIG. 2 show a winding machine of the invention. The frame 1 of the winding machine supports a rotatable spindle support 2, in which two winding spindles 3, 4 with their drives 5, 6 are mounted rotatably. By rotating the spindle support 2, the winding spindles 3, 4 can each be swiveled alternately into a doffing range 7 and into a winding range 8. A contact roller 9 is disposed above the winding spindle 4 in the winding range. Two yarn paths with two bobbins are shown in the winding machine illustrated here. This is representative of one or even a higher number of yarn paths. The winding process takes place synchronously for all yarn paths. Although only one yarn path has been described below, it also includes other existing yarn paths.

The equipment (not illustrated here) for producing and treating yarn feeds the yarn 10 by way of a top yarn guide 11. The sequence of the prior art winding process before the situation shown in FIG. 1 is described below. The positions of the winding spindles, yarn guides, and the yarn path therefore differ from FIG. 1. The winding spindle 3 is still disposed in the winding range 8 at this point in time. The advancing yarn 10 is traversed by the traversing device 12 within a traversing range 13 parallel to the axis of the winding spindle 4. The yarn is then guided over the rotatably mounted contact roller 9 and wound up on the bobbin 15, which is clamped on the winding spindle 3. The winding spindle 4 is equipped with an empty tube 16 and is disposed in the doffing range 7.

At the moment at which the bobbin 15 has reached its final diameter, the spindle support 2 is rotated so that the winding spindles 3 and 4 pass into the doffing range and the winding range respectively and thus correspond to the illustration in FIG. 1. The direction of rotation of the spindle support 2 is selected in such a way that it corresponds to the direction of rotation of the winding spindles 3 and 4.

While the yarn 10 continues to accumulate on the bobbin 15, a yarn guide 17 driven by a drive means 20 guides the yarn 10 in the traversing range out of the traversing range and into the catching range 14. Below the winding spindle 4 disposed in the winding range, a yarn guide 18 driven by a drive means 21 likewise guides the yarn 10 out of the traversing range 13 and into the catching range 14, while a third yarn guide 19 provided below the second yarn guide guides the yarn 10 back into a defined portion of the traversing range 13 before the yarn accumulates on the bobbin 15, where the yarn 10 forms a bead 23. A yarn section 10.1 is formed between the yarn guides 17 and 18. The yarn guides 17 and 18 are disposed on bars that can move parallel to the axis of the winding spindle. In the case of several yarn paths, accordingly a plurality of yarn guides is provided on each bar. The yarn guides 17 and 18 are moved out of the traversing range 13 toward the catching range 14 with the aid of the drive means 20 and 21. The guidance of the yarn before and behind the winding spindle 4 disposed in the winding range ensures that the yarn is precisely guided beyond the catch element 24 and then uniformly guided back by the common drive means 22, made to pass over the catch element 24, and is caught there. The speed of the yarn 10 and the peripheral speed of the catch element 24 have the same sign and approximately the same magnitude. The common drive means ensures that the yarn is guided over the catch element 24 at a narrowly defined angle, usually perpendicularly to the axis of the winding spindle. The yarn 10 is now entrained by the catch element 24 of the winding spindle 3 in the winding range 8 and wound up into bobbins on the tubes 16 clamped on the winding spindle 3. The connection to the bobbin 15 is cut off immediately after the catching process.

Figure 3:
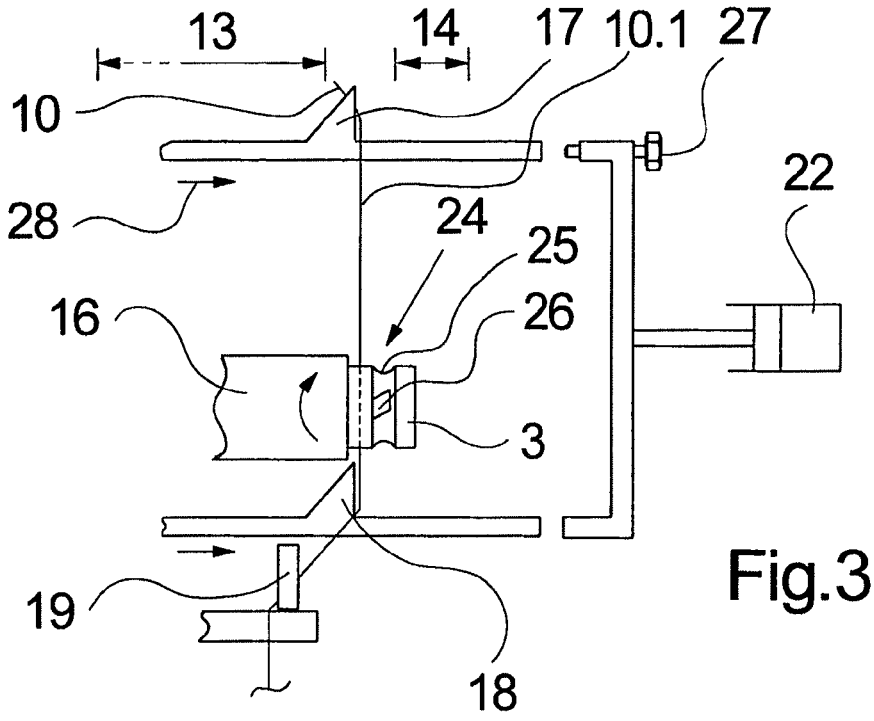
FIG. 3 shows the movement of the yarn guides in accordance with an exemplary embodiment of the invention.
Figure 4:
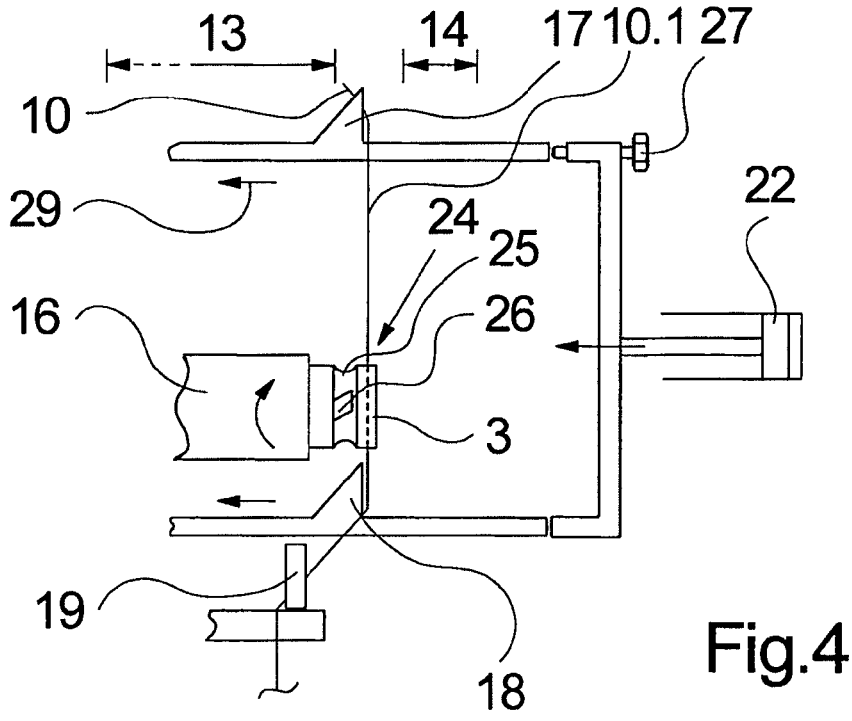
FIG. 4 shows another detail of the movement of the yarn guides in accordance with an exemplary embodiment of the invention.

FIGS. 3 and 4 describe in detail the course of movement of the yarn guides 17 and 18 during the catching process. The view corresponds to that shown in FIG. 1. The drive means 20 and 21 (not shown here) guide the yarn guides and thus the yarn section 10.1, which is guided by the yarn guides 17 and 18, along the winding spindle 3 and in this view behind the winding spindle 3 initially in a first movement section 28 out of the traversing range 13 toward the catching range 14, the yarn section 10.1 being guided beyond the catching range. The yarn guides 17 and 18 are then guided back in a second movement section 29 by a common drive means 22 toward the traversing range 13. The catching process is effected in this second movement section. The inversion of movement between the first movement section 28 and the second movement section 29 is advantageous though not strictly necessary. In the second movement section 29, the drive means 22 cooperate in such a way with the bars on which the yarn guides 17 and 18 are provided that the yarn section 10.1 guided via the yarn guides 17 and 18 is guided at a narrowly defined angle over the catch element 24. This helps achieve the required high reliability of catching the yarn even at high yarn speeds. The common drive means 22 and the yarn guides 17 and 18 are interconnected here by means of a unilaterally working positive coupling in the form of a loose coupling. The common drive means and the yarn guides are thus interconnected with play. Other designs of embodiments, for example, a fixed connection between the common drive means 22 and one of the yarn guides as well as a loose connection between the common drive means 22 and the other yarn guide will be easily obvious to a person skilled in the art and fall within the scope of the present invention. Flexible elements such as springs can also perform the same function as that of the loose coupling.

The yarn usually runs perpendicularly to the axis of the winding spindle. An adjusting element 27 can adjust and optimize this angle. The catch element 24 here is composed of a catch groove 25 and a catch hook 26. As the yarn laterally passes over the catch element 24, it initially falls into the catch groove 25 and is then reliably caught by the catch hook 26. Other design forms of the catch element 24, especially one without a catch groove 25, are also feasible and fall within the scope of the present invention.

Figure 5:
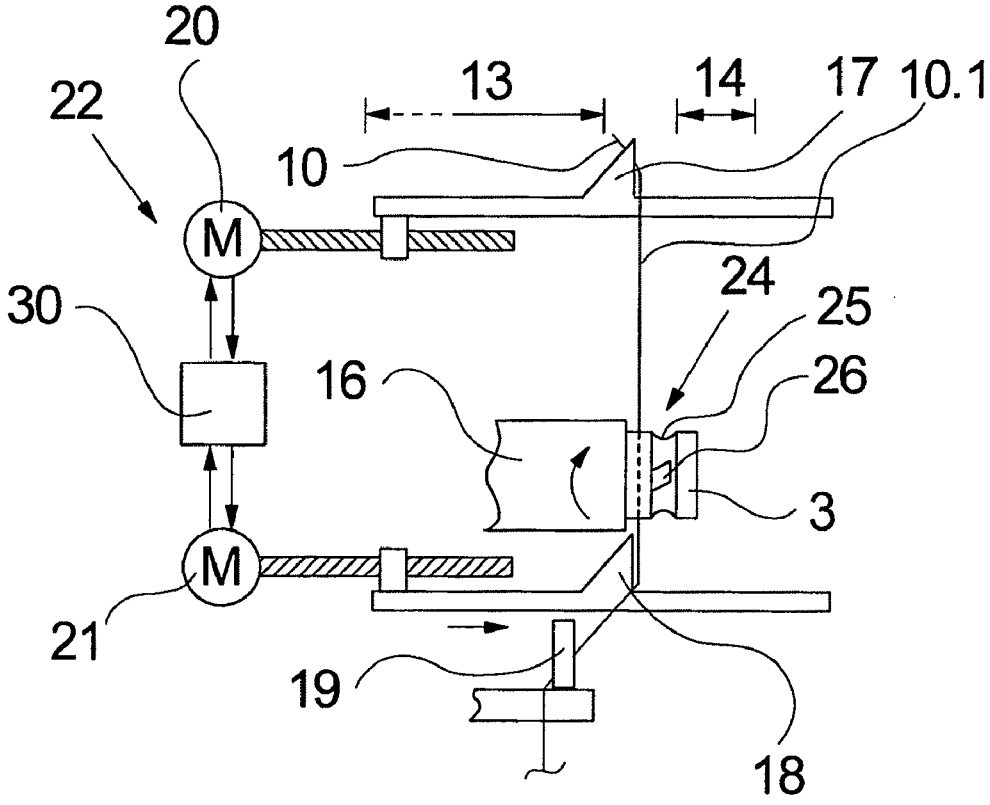
FIG. 5 shows another exemplary embodiment of the common drive means of the yarn guides in accordance with the invention.
Figure 6:
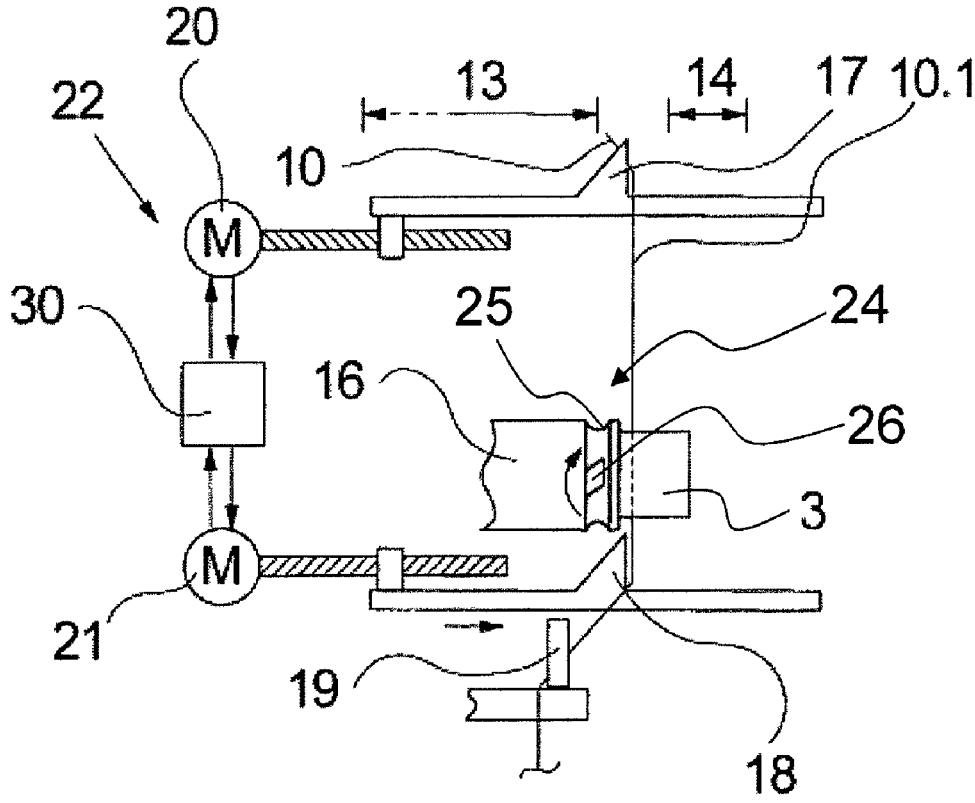
FIG. 6 shows a catch element disposed on a tube in accordance with another exemplary embodiment of the invention.

FIG. 5 shows a version of the common drive means 22 shown in FIGS. 3 and 4. Here, the common drive means are implemented by a common control mechanism 30 that coordinates the drives 20 and 21 and activates them preferably synchronously. In the course of movement of this version of the common drive means, the drives 20 and 21 are first activated individually in a first section of the movement. In the second section of the movement, the control mechanism coordinates the drives 20 and 21 with each other by means of the control mechanism 30 in such a way that they can be moved synchronously. For this purpose, it is possible to use stepping motors or position-controlled drives, the position of which is detected by a position measuring system and reported back to the control mechanism 30.

That which is claimed:

1. A method for catching and winding an advancing yarn on a winding tube held by a rotating winding spindle, said method comprising:

continuously taking up the advancing yarn with a winding tube;

forming a section of the yarn between a first yarn guide and a second yarn guide;

guiding the section of the yarn towards a catch element on a periphery of the winding spindle or the winding tube by moving the first yarn guide by a first drive means and a second yarn guide by a second drive means in the axial direction of the rotating winding spindle, wherein the movement of the yarn guides is divided into two movement sections, feeding the yarn section being guided in a first movement section towards the catch element and catching the yarn section with the catch element in a second movement section, wherein the first yarn guide and the second yarn guide are both guided back by a common third drive means in the second movement section and the yarn guides for guiding the yarn section are moved simultaneously at least in the second movement section and wherein an inversion of direction is effected between the first and the second movement sections;

wherein feeding the section of the yarn to the catch element occurs by simultaneous movement of the yarn guides.

2. The method according to claim 1, wherein the yarn guides for guiding the yarn section are moved simultaneously and at the same speed at least in the second movement section.

3. The method according to claim 2, wherein the yarn guides for guiding the yarn section are moved simultaneously and at the same speed at least in the second movement section, the yarn section running substantially orthogonally to the axis of rotation of the rotating winding spindle.

4. The method according to claim 1, wherein the yarn guides for guiding the yarn section are partly moved one after the other.

5. The method according to claim 1, wherein the yarn guides for guiding the yarn are partly moved independently of each other.

6. The method according to claim 1, wherein a running direction of the yarn and a peripheral speed of the catch element are parallel at the point of yarn contact.

7. The method according to claim 1, wherein the yarn is drawn continuously and taken up by a bobbin clamped on a second rotating winding spindle.

8. The method according to claim 7, wherein the yarn is guided by a stationarily held third yarn guide before the yarn accumulates on the bobbin.

9. A winding machine for continuously winding up yarns that are each assigned to a winding station into bobbins, said winding machine comprising:

a traversing device for traversing the yarns in the axial direction of the bobbins within a traversing range;

a rotatably mounted spindle support;

a plurality of winding spindles rotatably mounted on the spindle support for receiving the bobbins, the winding spindles being guided alternately by rotating the spindle support into a winding range for winding the yarns and into a doffing range for removing the completely wound bobbins;

catch elements, which are disposed at each winding station and are connected to the winding spindle and are used for locking the yarn into position;

a first yarn guide for each winding station, which first yarn guide can be displaced in the axial direction of the winding spindle and is disposed before the winding spindle located in the winding range within the range of the traversing device in the running direction of the yarn; and a second yarn guide for each winding station, which second yarn guide can be displaced in the axial direction of the winding spindle and is disposed behind the winding spindle located in the winding range and before the winding spindle located in the doffing range in the running direction of the yarn, wherein a common third drive means is provided, which jointly displaces the first and the second yarn guides, and wherein the yarn guides are interconnected during said displacement, wherein the first and the second yarn guides can be displaced in a doffing direction out of a traversing stroke and in an opposite winding tube loading direction into the traversing stroke and that the first yarn guide is driven in the doffing direction by a separate first drive means and wherein the second yarn guide is driven in the doffing direction by a separate second drive means, wherein the first yarn guide and the second yarn guide are jointly driven in the winding tube loading direction by the common third drive means.

10. The winding machine according to claim 9, wherein a third yarn guide is provided for each winding station, the third yarn guide being disposed between the second yarn guide and the winding spindle located in the doffing range in the running direction of the yarn as well as within a traversing range defined by the stroke of the traversing device when seen in the axial direction of the winding spindle.

11. The winding machine according to claim 9, wherein the connection between the first and the second yarn guide during their joint displacement by the drive means is a mechanical connection.

12. The winding machine according to claim 9, wherein the common drive means and at least one of the yarn guides are interconnected with play.

13. The winding machine according to claim 9, wherein the drive means work pneumatically.

14. The winding machine according to claim 9, wherein the catch element comprises a catch hook, which is oriented away from the traversing range and which cooperates with the yarn in such a way that the catch hook catches the yarn when a yarn section is displaced toward the traversing range.

15. The winding machine according to claim 9, wherein the catch element comprises a catch groove, extending tangentially around the winding spindle.

16. The winding machine according to claim 9, wherein the first and the second yarn guides are disposed in such a way relative to each other that the yarn runs substantially perpendicularly to the axis of the winding spindle during the catching operation between said yarn guides.

17. The winding machine according to claim 16, wherein an adjusting element is provided using which the angle between the yarn and the axis of the winding spindle can be adjusted.

18. The winding machine according to claim 9, wherein the catch element is attached on the tube.

* * * * *